US006165626A

United States Patent [19]

Bularca

[11] Patent Number: 6,165,626

[45] Date of Patent: Dec. 26, 2000

[54] LAMINATED ASSEMBLY AND METHOD OF MANUFACTURE

[75] Inventor: Valeriu Bularca, Skokie, Ill.

[73] Assignee: Philips Electronics North America Corporation, New York, N.Y.

[21] Appl. No.: 08/106,009

[22] Filed: Aug. 13, 1993

[51] Int. Cl.[7] ..... H01F 3/02; B21D 28/00

[52] U.S. Cl. ..... 428/583; 428/588; 428/596; 29/609; 29/738; 29/760; 336/234

[58] Field of Search ..... 428/583, 588, 428/596, 638; 29/609, 738, 760; 336/234

[56] References Cited

U.S. PATENT DOCUMENTS

| | | | |
|---|---|---|---|
| 1,315,827 | 9/1919 | Frank | 336/234 |
| 2,294,322 | 8/1942 | Van Der Woude | 29/609 |
| 2,907,966 | 10/1959 | Dierstein | 336/234 |
| 3,176,253 | 3/1965 | Radtke | 29/609 |
| 3,201,731 | 8/1965 | Baenziger et al. | 29/609 |
| 3,387,245 | 6/1968 | Czernobil | 336/234 |
| 3,491,437 | 1/1970 | Small | 29/609 |

FOREIGN PATENT DOCUMENTS

| | | | |
|---|---|---|---|
| 662627 | 5/1963 | Canada | 29/738 |
| 3103945 | 9/1982 | Germany . | |
| 205833 | 1/1984 | Germany . | |
| 1175593 | 8/1985 | Russian Federation . | |
| 1506055 | 4/1978 | United Kingdom . | |
| 2048575 | 12/1980 | United Kingdom | 29/609 |

*Primary Examiner*—John J. Zimmerman
*Attorney, Agent, or Firm*—Bernard Franzblau

[57] ABSTRACT

A laminated magnetic core assembly and method of manufacture having at least one notch formed along opposite sides of a strip material from which the laminations are formed. The notches on the opposite sides of the strip are punched out and separated from each other by a fixed distance. The notches minimize the amount of scrap material by avoiding the need for increasing the width of the strip from which a narrower strip having precision cut sides is formed.

21 Claims, 4 Drawing Sheets

LAMINATED ASSEMBLY AND METHOD OF MANUFACTURE

BACKGROUND OF THE INVENTION

This invention relates generally to a laminated assembly, and more particularly to a method for making a laminated magnetic core in which the amount of scrap material is minimized.

A laminated magnetic core typically includes three assemblies of laminations connected together. In manufacturing a laminated assembly, the laminations are pressed together within a die. The laminations include precision cut sides/edges which are positioned against chocks of the die. The chocks slightly squeeze, support and position each lamination within the die. Each lamination includes stakes which are pressed into an adjacent lamination so as to connect adjacent laminations together in forming the laminated assembly.

The width of each lamination is slightly larger than the distance between each pair of opposing chocks. A frictional/interference fit is therefore created between the laminations and chocks. The chocks provide the back-pressure support required by the laminations in pushing stakes of one lamination into an adjacent lamination as the laminations are pressed together. When the distance between the sides of the lamination is not properly dimensioned (i.e., more or less than being slightly larger than the distance between an opposing pair of chocks), the lamination cannot be properly seated between the chocks of the die. Under such conditions, the chocks cannot provide the necessary back-pressure to withstand the pressing of its stakes into an adjacent lamination.

The width of a strip of material from which laminations are formed typically has a minimum tolerance of ±0.003 inches. Proper chocking, that is, supporting and squeezing of the laminations between the chocks is not possible when the distance between the edges of each lamination varies within this tolerance range.

In order to avoid variation in lamination width, due to variation in strip width, conventional manufacturing techniques provide laminations with precision cut sides using a "cut all around" method. This method requires that the laminations be cut from a strip of material which is wider than the width of the lamination to be formed.

The cut all around method avoids the problem of an impermissible tolerance range by providing a precise distance (width) separating the sides of each lamination. Unfortunately, the excess material produced by the cut all around method (i.e. extra material on each side of the strip which is not used in forming the lamination) ends up as scrap. This scrap adds to the cost of manufacture.

Accordingly, it is desirable to provide an improved method for manufacturing a laminated assembly in which the amount of scrap material is substantially minimized. The method of manufacture should be capable of mass production and easily incorporated into a conventional manufacturing method in producing laminated assemblies.

SUMMARY OF THE INVENTION

Generally speaking, in accordance with the invention, a method for the manufacture of a laminated assembly includes the steps of forming at least one notch along an edge of at least one lamination, positioning the laminations between at least two chocks of a die wherein said at least one notch receivingly engages one of said at least two chocks and connecting the laminations together in forming the laminated assembly.

The laminations are provided from a strip of material having a pair of opposing sides. Opposing pairs of notches are first formed along the sides of the strip. Laminations are then formed from the strip. One or more laminations can be formed between at least one pair of opposing notches. Each pair of opposing notches are separated from each other by the same fixed distance.

The fixed distance is dimensioned so that the laminations formed from the strip provide an appropriate interference fit with the chocks of the die without regard to the overall width of the strip. In other words, the notches along the sides of the strip, into which the chocks slide, compensate for the width of the strip being too large (i.e. oversized). Consequently, oversized strips can be cut into properly dimensioned laminations that fit within the die. It is therefore unnecessary to employ the "cut all around" method in providing laminations which fit between the chocks of a die. More particularly, the amount of scrap material is substantially minimized by providing notches which eliminate the need for precision cutting of the strip edges.

In accordance with one embodiment of the invention, at least one notch is formed along each edge of each lamination. When two or more laminations are formed from the strip between at least one pair of opposing notches, at least one notch is formed along edges of two different laminations.

It is another feature of the invention to form stakes in at least one lamination. The stakes are for engagement of an adjacent lamination as the laminations are pressed together. It is yet another feature of the invention to form a first lamination without stakes at one end of the assembly. The first lamination has a plurality of openings for engaging the stakes from an adjacent lamination. In particular, each laminated assembly has stakes formed in every lamination except the first lamination. In forming a laminated magnetic core assembly, all laminations are made from a metallic material.

Each notch is preferably formed by stamping the strip so as to remove material therefrom. In forming the stakes, the strip is punched so as to displace material therefrom.

It is another aspect of the invention to provide an improved laminated assembly which includes a plurality of laminations connected to each other by pressing the laminations together between at least two chocks of a die. At least one lamination includes an edge having at least one notch for receivingly engaging one of the at least two chocks as the laminations are being pressed together. At least one lamination also includes stakes for connecting itself to an adjacent lamination. In the preferred embodiment, each lamination includes an edge having a plurality of notches. Each notch receivingly engages a corresponding chock as the laminations are being pressed together.

Accordingly, it is object of the invention to provide an improved method for the manufacture of a laminated assembly which minimizes the amount of scrap material produced.

It is another object of the invention to provide an improved method for the manufacture of a laminated assembly which reduces the cost of manufacture.

Still other objects and advantages of the invention will, in part, be obvious and will, in part, be apparent from the specification.

The invention accordingly comprises several steps and a relation of one or more of such steps with respect to each of the others, and the device embodying features of construction, combination of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in combination with the accompanying drawings, in which.

DETAILED DESCRIPTION OF THE PREFERRED EMBODIMENT

Figure 1:
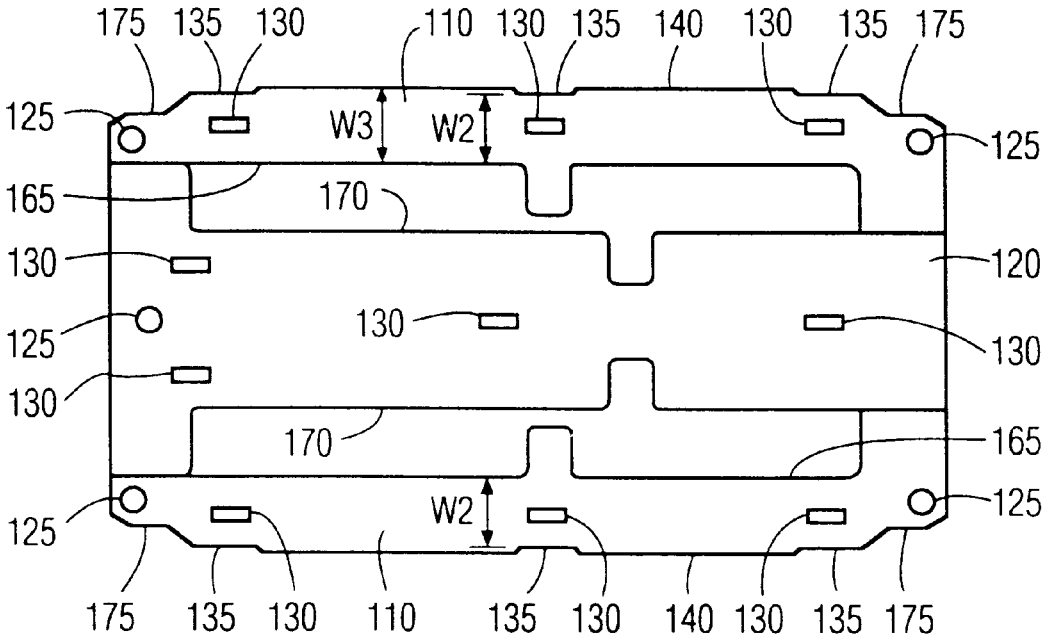
FIG. 1 is a top plan view of a laminated magnetic core in accordance with the invention.

In accordance with the invention, as shown in FIG. 1, a laminated magnetic core 50 includes two assemblies of F-type laminations 110 and one assembly of T-type laminations 120. Each assembly of F-type laminations 110 and T-type laminations has the same number of laminations. Each F-type lamination 110 and T-type lamination 120 also includes at least one pilot-hole 125 and a plurality of stakes 130. Pilot-holes 125 are used for properly positioning a strip of material 100 (as further discussed below in connection with FIGS. 3A–3D) as portions thereof are stamped and punched in forming the F-type laminations 110 and T-type laminations 120. Stakes 130 are actually raised portions of each lamination which serve as projections. These projections are inserted into corresponding stakes 130 (or openings located at the same position as stakes 130) of an adjacent lamination.

Figure 2A:
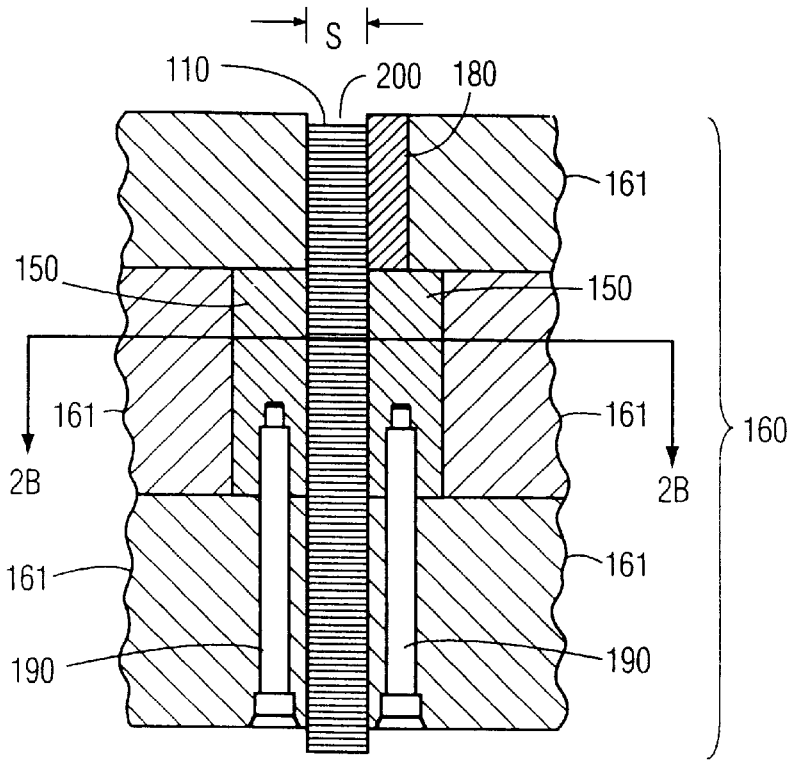
FIG. 2A is a cross-sectional view of a laminated assembly within a die.
Figure 2B:
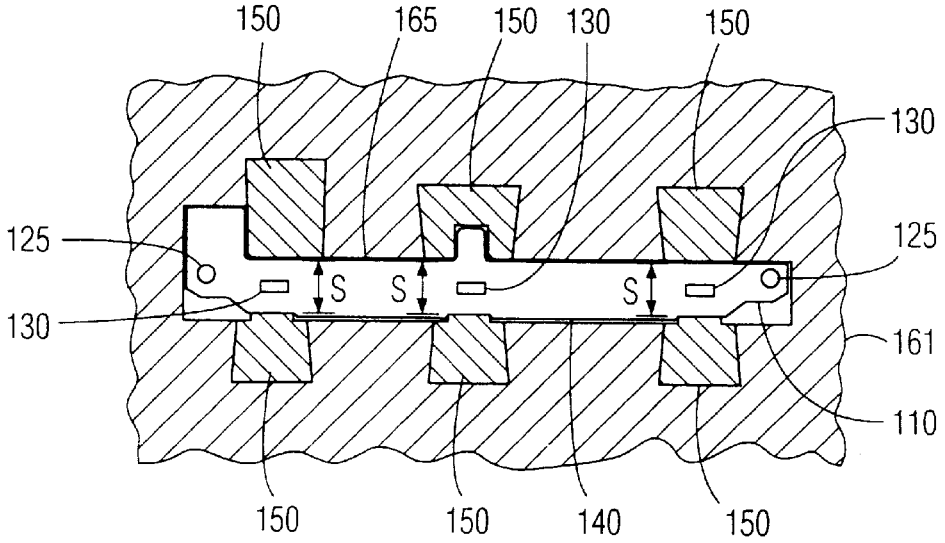
FIG. 2B is a fragmented cross-sectional view taken along lines 2B—2B of FIG. 2A rotated by 90°.

Assembly 50 is preferably made of a metallic material such as, but not limited to, silicon steel. F-type laminations 110 each include a side/edge 140. Sides 140 are not formed by a conventional cut all around method, that is, sides 140 are not precision cut from an oversized piece of material. Such precision cutting is avoided by providing a plurality of notches 135 along each side 140. As shown in FIGS. 2A and 2B, notches 135 ensure that the outside laminations of assembly 50, which in accordance with the invention are F-type laminations 110, can be slid between, so as to provide an interference fit with, a plurality of chocks 150 of a die 160.

A distance W2, as shown in FIG. 1, exists between notch 135 and a stamped edge 165 of the F-type lamination 110. An interference fit between F-type laminations 110 and chocks 150 results from distance W2 being slightly larger than a distance S between an opposing pair of chocks 150 as shown in FIGS. 2A and 2B.

As shown in FIG. 1, a distance W3 separating side 140 and stamped edge 165 of the F-type lamination 110 can therefore be equal to or larger than the distance W2 without adversely affecting the interference fit required between each F-type lamination 110 and an opposing pair of chocks 150. In particular, it is no longer necessary to employ the conventional cut all around method wherein the width of a strip of material be dimensioned to ensure proper interference fits for all laminations formed therefrom. Stamped edges 165 of F-type laminations 110 and a pair of stamped edges 170 of T-type lamination 120 are formed from the strip of material using conventional stamping techniques well-known in the art. Although not shown, T-type laminations 120 are also connected together using a die similar to die 160 shown in FIGS. 2A and 2B. Indentations 175 are formed at the corners of the strip of material in order to accommodate clips (not shown) in holding each staked lamination assembly together.

As shown in FIG. 2A, die 160 includes a plurality of different sections 161. Sections 161 represent different plates of die 160. A passageway/chute 200 extends through each section 161. Passageway 200 has a width slightly larger than the distance S. A plurality of guides 180 are positioned within die 160 and serve to guide F-type laminations 110 as the latter are placed within passageway 200 between chocks 150. A pair of pins or other suitable attaching devices 190 securely position chocks 150 within die 160 such that chocks 150 define a slightly narrowed portion of passageway 200.

Each F-type lamination 110 is squeezed (i.e., slightly flexed) between chocks 150 by being pressed down into passageway 200 by a punch (not shown). As the topmost lamination 110 is pressed down by the punch onto an adjacent lamination 110, the topmost lamination 110 is connected to the adjacent lamination within die 160 by pressing stakes 130 of the topmost lamination into the stakes of the adjacent lamination 110.

Laminated assemblies are separated from each other within die 160 by forming openings in lieu of stakes 130 in the first lamination to form each assembly. More particularly, the first lamination of a laminated assembly within die 160 is stamped with openings rather than stakes in the position where the stakes would have been. Consequently, the first lamination of one assembly, which rests within die 160 upon the last lamination of the previous assembly, has no stakes for connection to the last lamination of the previous assembly.

Figure 3A:
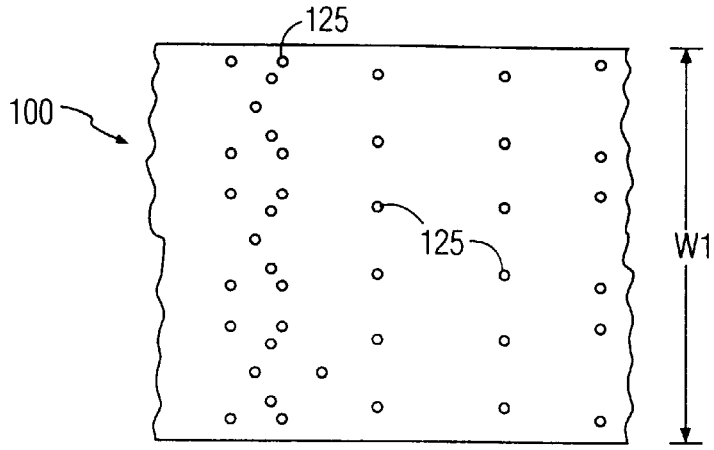
FIGS. 3A, 3B, 3C and 3D serially illustrate a method for stamping a strip of material in accordance with the invention.
Figure 3B:
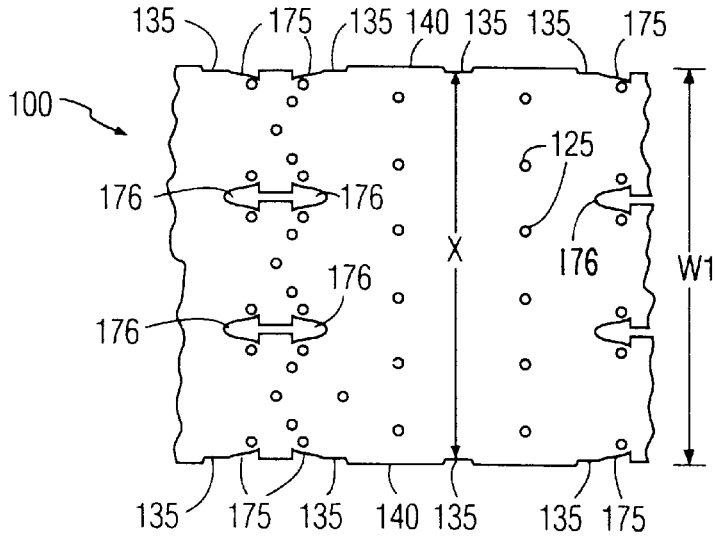

As shown in FIGS. 3A and 3B, a width W1 of strip 100 typically has a minimum, tolerance of ±0.003 inches. Without the strip having precision cut sides, as employed by the conventional cut all around method, proper chocking, that is, support of the laminations by squeezing the laminations between chocks 150, has not been previously possible. Through use of notches 135*a*, variation in the width of strip 100 does not require the formation of precision cut sides for proper chocking. These notches compensate for a variation in the width W1 of strip 100.

The steps in stamping strip 100 are as follows. As shown in FIG. 3A, strip 100 is first punched with a plurality of pilot holes 125 for piloting/locating the position along which strip 100 is to be further processed. Pilot holes 125, as used in either embodiment, also permit stringing of the laminated assemblies together. More particularly, as the laminations come out of the passageway (chute) 200, the laminations can be strung together by passing a wire or the like through pilot holes 125 for further processing of the laminated assemblies.

As shown in FIG. 3B, a punch (not shown) removes portions of strip 100 along sides/edges 140 so as to form notches 135 and indentations 175. The distance between opposing sides 140, represented by a width W1, is effectively reduced by notches 135 to a distance X. Openings 176 are also formed by stamping strip 100 resulting in the removal of additional material therefrom. As shown in FIG. 3D, openings 176 eventually form indentations 175 for F-type laminations 110.

Figure 3C:
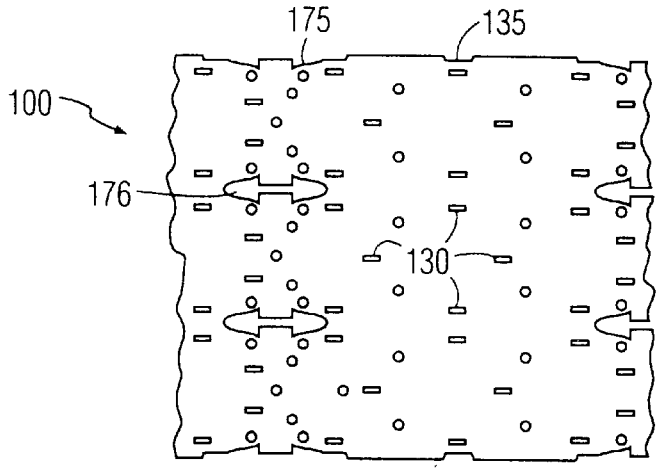
Figure 3D:
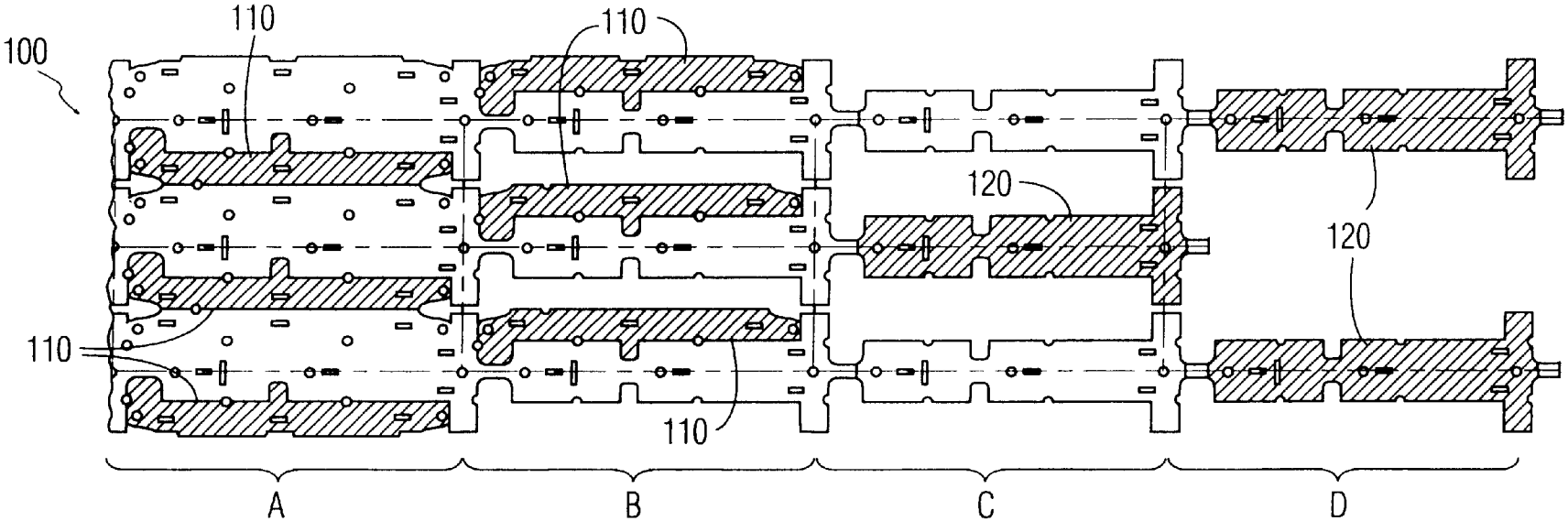

As shown in FIG. 3C, a plurality of stakes 130 are punched in strip 100 so as to displace portions of the latter. Stakes 130 are projections below the surface of strip 100.

Strip 100, as shown in FIG. 3D, is now ready to have F-type laminations 100 and T-type laminations 120 punched out therefrom. FIG. 3D illustrates a plurality of strokes A, B, C, and D of a punch (not shown). The darkened laminations of FIG. 3D identify the one or more laminations punched out from strip 100 during a particular stroke. During stroke A, three F type laminations are punched out of strip 100 and pushed into separate passageways/chutes 200 of a die 160. Under stroke B, three additional F type laminations 110 are punched out of strip 100 into three additional passageways/chutes 200 of die 160. During strokes C and D three T-type laminations 120 are punched out of strip 100 into a passageway of die 160 for assembly similar to that previously discussed in connection with F-type laminations 110.

As can now be readily appreciated, the invention by providing notches 135 on the sides of strip 100 provides precision cut areas on which to apply the chocking necessary for staking. The need for oversizing strip 100 so as to cut away material from its width in forming precision cut sides (i.e. for proper dimensioning of the laminations in order for same to be squeezed between the chocks of a die) can be eliminated. In other words, the need to employ the conventional cut all around method is eliminated. Notches 135 result in a substantially scrapless method of forming the F-type and T-type laminations saving material and therefore substantially reducing manufacturing cost.

It will thus be seen that the objects set forth above, among those made apparent from the preceding description, are efficiently attained and since certain changes may be made in the above constructions without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A method for manufacture of a laminated assembly comprising the steps of:

forming at least one notch along an edge of at least one lamination;

positioning the laminations between at least two chocks of a die wherein said at least one notch frictionally engages one of said at least two chocks to support the at least one lamination against a press fit bonding force during a subsequent bonding step;

press fit bonding the laminations together to form a laminated assembly; and removing the laminated assembly from between the chocks.

2. The method of claim 1, wherein at least one notch is formed along an edge of each lamination.

3. The method of claim 1, further including providing the laminations from a strip of material having a pair of opposing sides wherein opposing pairs of notches are formed along the sides of the strip, the notches of each opposing pair being separated from each other by the same fixed distance.

4. The method of claim 1, wherein said at least one notch for frictionally engaging said at least one chock is formed along only one edge of said at least one lamination.

5. The method of claim 3, wherein at least one lamination is formed between at least one opposing pair of notches.

6. The method of claim 3, wherein at least two laminations are formed between at least one opposing pair of notches and wherein at least one notch is formed along edges of two different laminations.

7. The method of claim 1, further including forming stake means in said at least one lamination, said stake means for engagement of an adjacent lamination as the laminations are pressed together.

8. The method of claim 7, further including forming a first lamination at one end of the assembly, said first lamination having receiving means for engaging said stake means from an adjacent lamination wherein said stake means are formed in every lamination except said first lamination.

9. The method of claim 1, wherein the laminations are made of a metallic material.

10. The method of claim 1, wherein the step of forming at least one notch includes stamping said at least one lamination so as to remove material therefrom.

11. The method of claim 7, wherein the step of forming stake means includes punching said at least one lamination so as to displace material therefrom.

12. The method of claim 11, wherein said strip of material is metallic and wherein said opposing pairs of notches and stake means are formed by stamping and punching said strip so as to remove and displace portions thereof from said strip, respectively.

13. A laminated assembly, comprising a plurality of laminations connected to each other by successively pressing laminations against a stack of previously pressed together laminations frictionally held temporarily between at least two chocks of a die during manufacture, wherein each lamination includes an edge having at least one notch means for frictionally engaging solely during manufacture one of said at least two chocks as the laminations are being pressed together.

14. The laminated assembly of claim 13, wherein at least one lamination includes stake means for connecting said at least one lamination to an adjacent lamination.

15. The laminated assembly of claim 13, wherein each lamination includes an edge having a plurality of notch means, each notch means for receivingly engaging a corresponding chock as the laminations are being pressed together.

16. The laminated assembly of claim 13, wherein all laminations except one include stake means.

17. The laminated assembly of claim 13, wherein each lamination is made of a metallic material.

18. In a method of laminating, wherein successive laminations are pressed against a previously bonded stack of laminations, the stack being frictionally supported between at least two opposing chocks of a die, the improvement comprising the step of forming a notch along an edge of at least one lamination to frictionally engage one of the chocks, the notch being positioned so as to accurately define a lamination dimension that determines the tightness of the frictional fit of the lamination between the chocks rather than an accurate cutting of said edge, thereby eliminating cutting waste resulting from such accurate cutting of said edge.

19. The method of claim 18 wherein the laminations are bonded to one another by forming stakes and recesses in the laminations and press fitting the stakes formed in one lamination into the recesses formed in an adjacent lamination.

20. A laminated assembly comprising a plurality of laminations that have been connected to each other by successively pressing laminations against a stack of previously pressed together laminations frictionally supported between at least two chocks of a die, at least one of the laminations having a notch along an edge thereof that defines a lamination dimension that determines the tightness of the frictional fit of the lamination between the chocks rather than an accurate cutting of said edge, said edge being an uncut edge of lamination stock.

21. A laminated assembly as defined in claim 20 wherein the laminations have been bonded to one another by press fitting stakes in one lamination into recesses in an adjacent lamination.

* * * * *